US009757849B2

(12) United States Patent
Stepp et al.

(10) Patent No.: US 9,757,849 B2
(45) Date of Patent: Sep. 12, 2017

(54) PULLER

(71) Applicants: Randy L Stepp, White City, OR (US); James P Wilson, Eagle Point, OR (US)

(72) Inventors: Randy L Stepp, White City, OR (US); James P Wilson, Eagle Point, OR (US)

( * ) Notice: Subject to any disclaimer, the term of this patent is extended or adjusted under 35 U.S.C. 154(b) by 187 days.

(21) Appl. No.: 14/845,219

(22) Filed: Sep. 3, 2015

(65) Prior Publication Data

US 2016/0082578 A1 Mar. 24, 2016

Related U.S. Application Data

(60) Provisional application No. 62/071,188, filed on Sep. 18, 2014.

(51) Int. Cl.

*B25B 27/02* (2006.01)
*B25B 27/00* (2006.01)
*B25B 27/06* (2006.01)

(52) U.S. Cl.

CPC ..... *B25B 27/023* (2013.01); *B25B 27/0028* (2013.01); *B25B 27/026* (2013.01); *B25B 27/06* (2013.01); *B25B 27/062* (2013.01); *Y10T 29/5387* (2015.01); *Y10T 29/53861* (2015.01)

(58) Field of Classification Search

CPC ... Y10T 29/5387; B25B 27/02; B25B 27/023; B25B 27/026; B25B 27/062; B25B 27/0028; B25B 27/06

USPC ..... 248/440, 465, 462, 421, 585; 254/10 R, 254/10 C; 242/574.1; 280/124.133; 29/261, 259, 262

See application file for complete search history.

(56) References Cited

U.S. PATENT DOCUMENTS 1,435,397 A * 11/1922 Hunt ..... B25B 27/023 29/261
1,462,437 A * 7/1923 Young ..... B25B 27/023 29/261
1,475,810 A * 11/1923 Frisz ..... B25B 27/023 29/261
1,534,350 A * 4/1925 Bassett ..... B25B 27/023 29/261
1,552,616 A * 9/1925 Kister ..... B25B 27/005 29/246
1,584,855 A * 5/1926 Eisenhuth ..... B25B 27/023 29/261

(Continued)

*Primary Examiner* — Larry E Waggle, Jr.
*Assistant Examiner* — Mahdi H Nejad
(74) *Attorney, Agent, or Firm* — Palomar Patent; Calif Tervo

(57) ABSTRACT

A puller for pulling an element, such as a pulley or seal, from an assembly to which it is fitted. The puller generally includes a central body having a longitudinal axis, an adjustment ring threaded on the body for moving longitudinally with rotation, slide followers coupled to the ring and moving longitudinally with ring rotation, a plurality of leg assemblies, each including a foot and two legs pivotly attaching the foot to the body so as to form a parallelogram, and a arm pivotly connecting each slide follower to a leg assembly for expanding or contracting the leg assembly. Each foot has one or more foot flanges, each with an engagement surface for engaging with the element to be pulled; the orientation of the engagement surfaces being predetermined so as to not disengage from the element and to provide uniform pull and minimum pressure.

8 Claims, 2 Drawing Sheets

(56) References Cited

U.S. PATENT DOCUMENTS 1,683,188 A * 9/1928 Howell ..... B25B 27/023 29/261
2,610,452 A * 9/1952 Hill ..... B24B 5/162 29/895.22
2,922,533 A * 1/1960 Barge, Jr. ..... B23Q 1/54 187/211
3,314,672 A * 4/1967 Persson ..... B60N 2/502 248/575
4,852,234 A 8/1989 Wheeler
4,908,925 A 3/1990 Johnson
5,224,254 A * 7/1993 McPeak ..... B25B 27/023 29/261
5,341,553 A 8/1994 Herzhauser
5,557,833 A * 9/1996 Pool ..... B25B 27/023 29/261
5,692,282 A 12/1997 Baca
5,819,386 A * 10/1998 Koppe ..... B25B 27/023 29/261
5,887,328 A * 3/1999 Rydin ..... B25B 27/02 29/259
5,983,474 A 11/1999 Koppe
6,223,410 B1 * 5/2001 Sroka ..... B25B 27/023 29/261
6,581,261 B1 * 6/2003 Chen ..... B25B 27/023 29/246
6,609,283 B1 * 8/2003 Somerville ..... B25B 27/023 29/255
6,665,919 B1 * 12/2003 Kurtz ..... B25B 27/023 269/3
6,895,646 B1 * 5/2005 Houg ..... B25B 27/026 29/252
7,322,087 B1 * 1/2008 Hu ..... B25B 27/023 29/255
8,146,221 B2 * 4/2012 Hung ..... B25B 27/026 269/24
8,464,411 B2 * 6/2013 Betcher ..... B66F 3/36 254/100
2005/0229373 A1 * 10/2005 Hu ..... B25B 27/023 29/261
2006/0200962 A1 * 9/2006 Hu ..... B25B 27/02 29/259
2009/0194750 A1 * 8/2009 Fan ..... B66F 3/36 254/100
2009/0236573 A1 * 9/2009 Hu ..... B66F 3/36 254/100
2012/0036690 A1 * 2/2012 Mueller ..... B25B 27/062 29/261
2013/0152353 A1 * 6/2013 Hu ..... B25B 27/023 29/261
2013/0304251 A1 * 11/2013 Garvey ..... G01N 29/225 700/213
2014/0223713 A1 * 8/2014 Chen ..... B25B 27/062 29/256
2016/0151867 A1 * 6/2016 Chen ..... B25B 27/062 29/261

* cited by examiner

PULLER

CROSS-REFERENCE TO RELATED APPLICATIONS

This application claims the benefit of U.S. Provisional Application No. 62/071,188, filed Sep. 18, 2014.

FIELD OF THE INVENTION

This invention relates in general to a pulling tool for pulling an element such as a pulley or wheel from a shaft or, alternatively, for pulling an element such as a bearing or race from its housing, and, more specifically, to a puller that retains the surface that engages with the element at a desired position and at a predetermined orientation.

BACKGROUND OF THE INVENTION

In many mechanical assemblies, one part is attached to another with an interference fit, also known as a press fit, friction fit, or jam fit. For example, a cylindrical shaft is press fitted with a component such as a bearing, impeller, gear, wheel or the like, which is mounted to rotate with the shaft. Similarly, many mechanical assemblies comprise arrangements wherein a component such as a bearing, race, seal, or the like is press fitted around its periphery to an opening in a housing, usually to encircle a shaft or the like extending through the opening of the housing. Typically the removal of such components from a shaft or housing for repair or replacement is problematic and requires use of a puller or similar tool.

Many types of pullers are available. Often the pulling devices are special-purpose devices that are designed to provide an "outside pull." In an outside pull, various clamping arms grip around the outside of an element, such as a pulley, and are then used to pull that element off of a shaft or the like. An "inside pull" is an alternative procedure that is effected by means of arms that have gripping ends that extend radially outwardly so as to engage the inside surface of an annular element such as a bushing or bearing for removal from a housing or sleeve, for example.

Therefore, it is desirable that a puller is adjustable to enable pulling or removal of elements having various inside or outside diameters.

It is desirable that a puller be reversible so as to provide both an inside as well as an outside pull.

It is desirable that a puller uniformly engages the element and locks onto or otherwise remains centered on the element during pulling to prevent the puller from disengaging and from damaging the element or surrounding parts. For example, U.S. Pat. No. 4,007,535 discloses a pulling device wherein the pulling arms, once positioned around an element, are locked into that position so that they cannot slip from the element which is being pulled It is desirable that the engaging faces maintain a predetermined relative angle, even with size adjustment, so as spread the pulling force over a large area so as to not damage the element due to excessive pressure at points. This quality is particularly important when engaging in an inside pull of a seal when the seal is to be reused.

Thus, there has developed an increased need for pulling devices that are flexible and may be used not only for inside pulls but also for outside pulls upon elements of varying diameter. Also such a pulling mechanism may desirably be locked into a specific diameter in either the inside or outside pull position. Also, desirably, the puller's surfaces that engage the element remain at a predetermined angle to the element regardless of size adjustment. Seeking such a construction has led to the development of the present invention.

SUMMARY OF THE INVENTION

This invention is a puller for pulling an element from an assembly to which it is fitted, such as pulling a pulley from a shaft or a seal from a housing, the element having an inner-facing face. The puller includes a central body having a longitudinal axis and including an outer portion, an inner portion, and a circumferential threaded portion on the outer portion. An adjustment ring or nut, threaded on the threaded portion, moves longitudinally with rotation of the nut. Slide followers, coupled to the nut, slide in channels in the body and move longitudinally with longitudinal movement of the nut.

A plurality of leg assemblies, each include a foot having a longitudinal axis parallel to the longitudinal axis of the body and two legs attaching the foot to the body so as to form a parallelogram such that, as the legs pivot, the longitudinal axis of the foot remains parallel to the longitudinal axis of the body. The foot has an inner portion including one or more radial flanges, each flange having an outer-facing engagement surface at a predetermined orientation to the longitudinal axis of the foot; the engagement surface for bearing against the inner-facing face of the element to be pulled. An arm pivotly connects each slide follower to a leg assembly for pivoting its leg assembly upon rotation of the nut such that the foot moves toward and away from the longitudinal axis of the body, i.e. contracts and expands.

A threaded central bore in the body provides for attachment of various force applicators, such as bridges, handles, jack screw, or slide hammers.

In an exemplary embodiment, the foot flanges are included in toe and heel pieces that are selectively attached to the foot and may have engagement surfaces specifically adapted to the engage with the element to be pulled so as to not damage the element or the puller.

The manner of adjustment of the invention places the engagement surfaces at a given radius and angular orientation so as to positively engage the element so as to not slip off and to provide uniform pull and minimum pressure.

Other features and many attendant advantages of the invention will become more apparent upon a reading of the following detailed description together with the drawings wherein like reference numerals refer to like parts throughout.

DETAILED DESCRIPTION OF THE INVENTION

Figure 1:
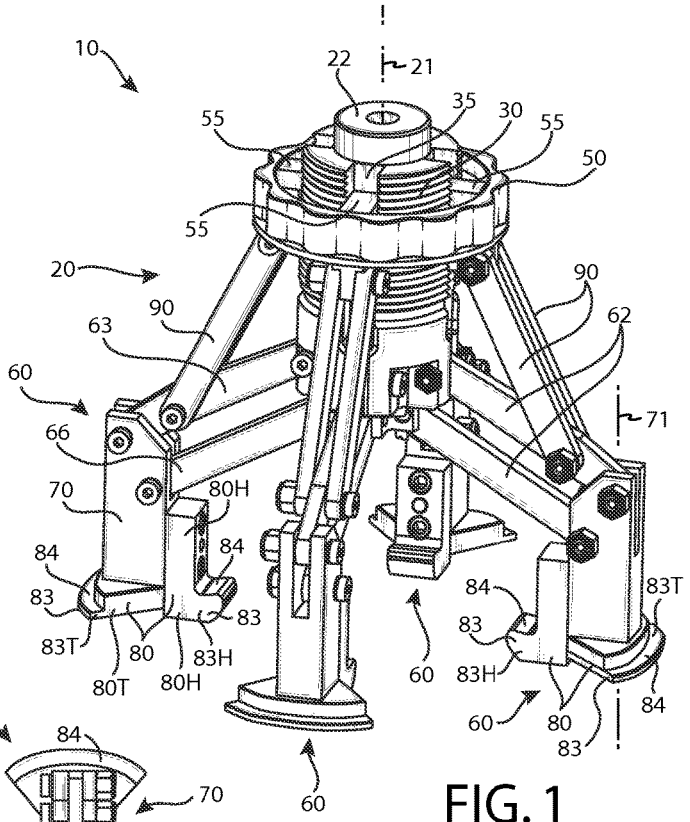
FIG. 1 is a perspective view of an exemplary embodiment of the puller of the invention.
Figure 2:
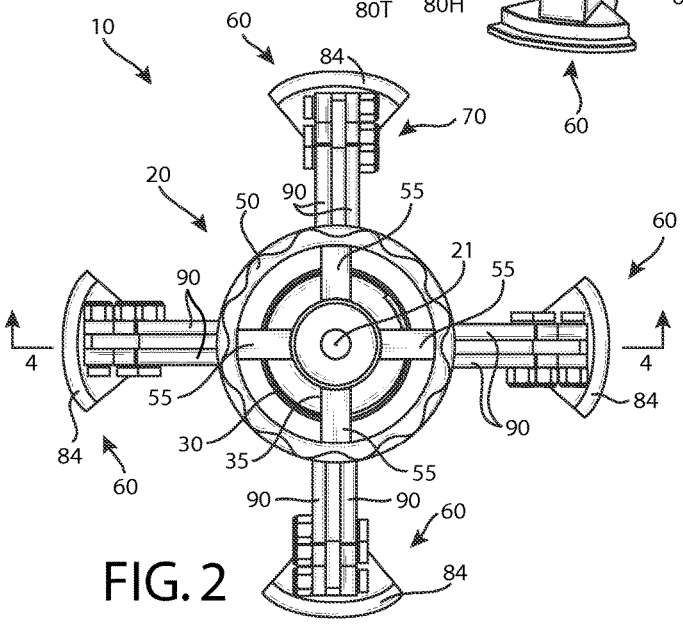
FIG. 2 is a top plan view of the puller of FIG. 1.
Figure 3:
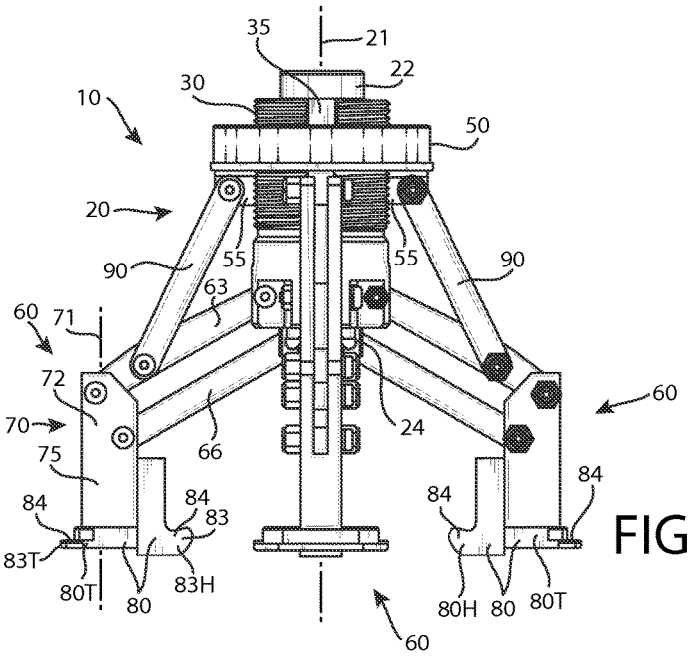
FIG. 3 is a front elevation view thereof.
Figure 4:
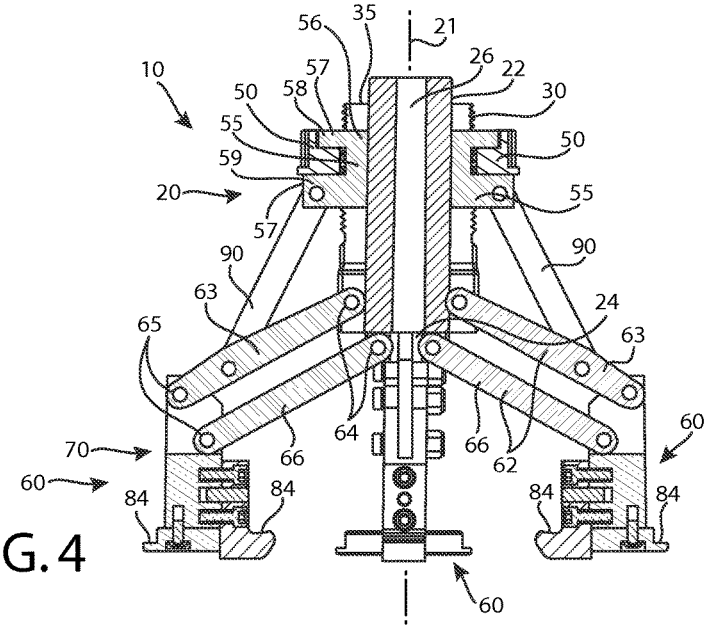
FIG. 4 is a vertical sectional view taken on line 4-4 of FIG. 2.

With reference now to the drawings, FIG. 1 is a perspective view of an exemplary embodiment of the puller 10 of the invention, FIG. 2 is a top plan view of puller 10 of FIG. 1, FIG. 3 is a front elevation view thereof, and FIG. 4 is a vertical sectional view taken on line 4-4 of FIG. 2.

Puller 10 pulls an element, such as a pulley or seal, from an assembly to which it is fitted. Puller 10 generally includes a central body 20 having a longitudinal axis 21, an adjustment nut or ring 50 threaded on body 20 so as to move longitudinally with rotation, ring follower means, such as sliders 55, coupled to ring 50 and sliding longitudinally in channels 35 in body 20 as ring 50 is rotated, a plurality of leg assemblies 60 pivotly connected to body 20, and arms 90 pivotly connecting sliders 55 to leg assemblies 60 such that, rotation of ring 50 moves sliders 55 longitudinally which moves arms 90 to pivot leg assemblies 60 so as to expand or contract them.

Each leg assembly 60 includes a foot 70 having one or more foot flanges 83, each with an engagement surface 84 for engaging the element to be pulled, and two legs 62 pivotly attaching foot 70 to body 20 so as to form a parallelogram. Engagement surfaces 84 have a predetermined orientation for engaging the element so as to not become disengaged and so as to provide uniform pull with minimum pressure. Rotation of ring 50 expands or contracts leg assemblies 60 to fixedly position engagement surfaces 84 for engagement and pulling. The parallelogram structure keeps engagement surfaces 84 at the predetermined orientation.

As best seen in FIG. 3, central body 20 includes an outer portion 22 for disposition distal to an element to be pulled, such as a pulley or seal, and an inner portion 24 for disposition more proximal to the element to be pulled.

Body 20 includes means, such as longitudinal bore 26, for attachment of a force applicator, not shown, for applying a pulling force to body 20. Longitudinal bore 26 would typically be used as a universal attachment means for force applicators, but other attachment means include bores, studs, fasteners, and the like, as are well-known in the art. Longitudinal bore 26 may be totally or partially threaded to accommodate various force applicators. Force applicators are well known in the art and include jack screws, bridges or T-handles, and slide hammers. A jack screw may screw into longitudinal bore 26 from outer portion 22 such that the jack screw's inner end bears against a shaft or housing retaining the element to be pulled so as to exert an outward force. Bridges or T-handles fastened to puller 10, such as to longitudinal bore 26, are used to apply a pulling force. They may be directly grasped by a user or by a machine. A slide hammer may be attached, such as to longitudinal bore 26, to apply impulsive pulling force.

Body 10 has a circumferential threaded portion 30 on its outer portion 22 for threadingly receiving adjustment nut or ring 50. Ring 50 has internal threads such that rotation of ring 50 moves ring 50 longitudinally. Ring 50 may have an external surface adapted, such as with ridges or knurls, to facilitate rotation of ring 50.

Ring follower means, such as sliders 55, are acted upon by ring 50 so as to move longitudinally as ring 50 rotates but without rotating with ring 50. In this manner, rotational movement is converted to longitudinal movement. In the exemplary embodiment, there is a slider 55 for each leg assembly 60. As best seen in FIG. 4, each slider 55 has a radially inward portion 56 slidingly disposed in a channel 35 in body 20 and a radially outward portion 57 slidingly coupled to said ring 50, such as with upper and lower flanges 58, 59. In this manner, movement of ring 50 applies longitudinal forces to slider flanges, such as outer flange 58 and inner flange 59, and channel 35 in body 20 applies reactive side forces to slider 55 such that slider 55 moves longitudinally. Although the term "slider" is used the sliders 55 would not have to necessarily "slide" but could include rollers on the bearing surfaces. Alternate ring follower means are contemplated. For example an alternate follower means includes a rolling or sliding coupling with a slot, rail, or channel in ring 50 for longitudinal movement therewith and a rolling or sliding coupling with slot, rail or channel in body 20 to prevent rotation of the follower means with rotation of ring 50.

The exemplary embodiment of puller 10 includes four leg assemblies 60 pivotly attached to body 20. Typically, puller 10 has two to four leg assemblies 60. The more leg assemblies 60, the more distributed the pulling force and the less likely the element pulled is to be damaged. For example, if the element is to be reused, four leg assemblies 60 may be preferable to two leg assemblies 60, as with, for example, a wheel hub seal on a truck wheel.

Each leg assembly 60 includes: two legs 62 including an outer leg 63 and an inner leg 66; and a foot 70. Foot 70 has a longitudinal axis 71 parallel to longitudinal axis 21 of body 20 and includes an outer portion 72 and an inner portion 75. Inner portion 75 of foot 70 includes one or more engagement flanges 83, such as toe flange 83T and heel flange 83H. Each flange 83 has an outer-facing, engagement surface 84 for bearing against an inner-facing face of the element to be pulled. Engagement surface 84 is at a predetermined orientation to longitudinal axis 71 of foot 70.

As best seen in FIG. 4, each leg 63, 66 includes a body end 64 pivotly connected to body 20 and a foot end 65 pivotly connected to its foot 70 so as to form a variable parallelogram such that, as legs 62 pivot, longitudinal axis 71 of foot 70 remains parallel to longitudinal axis 21 of body 20 and engagement surface 84 of flange 83 of foot 70 remains at the predetermined angle for engaging the element.

A plurality of arms 90 moves the leg assemblies 60. In the exemplary embodiment, each leg assembly 60 is moved by a pair of parallel arms 90. Each arm 90 has an outer end 92 pivotly connected to a slider 55, and an inner end 94 pivotly connected to its leg assembly 60, such as to outer leg 63, for pivoting leg assemblies 60 upon rotation of ring 50 such that foot 70 moves toward and away from longitudinal axis 21 of body 20 so as to adjust for various sizes of elements to be pulled.

In the exemplary embodiment, foot 70 has both a toe flange 83T facing away from the body longitudinal axis 21 so as to perform an inside pull, such as on a seal, and a heel flange 83H facing the body longitudinal axis 21 so as to perform an outside pull, such as on a pulley. A sole piece or pieces 80, such as a toe piece 80T having a toe flange 83T or heel piece 80H having a heel flange 83H, may be selectively attachable to inner portion 75 of foot 70, such as with bolts. Alternately, a single attachable sole piece 80, not shown, may have both toe and heel flanges 83T, 83H or could have a single flange and be reversible to provide the other flange as desired.

A multitude of attachable toe and heel pieces 80T, 80H can have flanges 83T, 83H and engagement surfaces 84 of different shapes for providing more specific engagement with various elements to be pulled. For example, as is shown in exemplary embodiment 10, toe flange 83T may be thin to fit behind a seal, such as a wheel hub seal on a truck wheel, and have an engagement surface 84 that is relatively planar and of large arc so as to not damage the seal upon removal. Heel flange 83H may be thicker and stronger and have an engagement surface 84 that is curved to more closely match the curvature of a pulley or other element to be pulled.

Although a particular embodiment of the invention has been illustrated and described, various changes may be made in the form, composition, construction, and arrangement of the parts herein without sacrificing any of its advantages. For example, axial pivot pins have been used for the pivot axes, but other types of pivot connections, well-known in the art, could be used. And, although a pair of parallel arms 90 is shown moving each leg assembly 60, with slight alterations apparent to one skilled in the art, one arm 90 could be used. Or, ring 50 may have means, such as flat circumferential surfaces or bores for receiving a tool, such as a wrench, for increasing torque applied to the ring 50. Therefore, it is to be understood that all matter herein is to be interpreted as illustrative and not in any limiting sense, and it is intended to cover in the appended claims such modifications as come within the true spirit and scope of the invention.

We claim:

1. A puller for pulling an element from an assembly to which it is fitted; the element having an inner-facing face; said puller comprising:

a central body having a longitudinal axis and including:
- an outer portion;
- an inner portion; and
- a circumferential threaded portion on said outer portion of said body;

an adjustment nut threaded on said threaded portion for moving longitudinally with rotation of said nut;

follower means coupled to said nut and said body for moving longitudinally with longitudinal movement of said nut;

a plurality of leg assemblies, each including:
- two legs including:
  - an outer leg; and
  - an inner leg; and
- a foot having a longitudinal axis parallel to said longitudinal axis of said body; said foot including:
  - an outer portion; and
  - an inner portion including:
    - one or more radial flanges, each flange having an outer-facing engagement surface at a predetermined orientation to said longitudinal axis of said foot; said engagement surface for bearing against the inner-facing face of the element to be pulled; each said leg having a body end pivotly connected to said body and a foot end pivotly connected to said foot so as to form a parallelogram such that, as said legs pivot, said longitudinal axis of said foot remains parallel to said longitudinal axis of said body and said engagement surface of said radial flange remains at the predetermined orientation; and an arm for each leg assembly including:
- an outer end pivotly connected to said follower means; and
- an inner end pivotly connected to said leg assembly for pivoting said leg assemblies upon rotation of said nut such that said foot moves toward and away from said longitudinal axis of said body.

2. The puller of claim 1 wherein said body further includes:

attachment means for attachment of a force applicator for applying a pulling force to said body.

3. The puller of claim 2 wherein said attachment means includes:

a longitudinal bore.

4. The puller of claim 2 wherein said attachment means includes:

a longitudinal bore that is at least partially threaded.

5. The puller of claim 1 wherein:

said body includes:
- a channel; and said follower means includes:
- a slider in said channel in said body.

6. The puller of claim 1 wherein said flanges include:

a toe flange that faces away from the body longitudinal axis for performing an inside pull; and a heel flange that faces the body longitudinal axis for performing an outside pull.

7. The puller of claim 1 wherein said inner portion of said foot includes:

a selectively attachable sole piece that includes said flange or flanges.

8. The puller of claim 1 wherein said inner portion of said foot includes:

a selectively attachable toe piece that includes one said flange that faces away from the body longitudinal axis for performing an inside pull; and a selectively attachable heel piece that includes another said flange that faces the body longitudinal axis for performing an outside pull.

* * * * *